US009328712B2

(12) United States Patent
Kawagoe et al.

(10) Patent No.: US 9,328,712 B2
(45) Date of Patent: May 3, 2016

(54) CONTROL DEVICE FOR INTERNAL COMBUSTION ENGINE

(75) Inventors: Jun Kawagoe, Numazu (JP); Hidetoshi Suzuki, Numazu (JP); Kei Hiramatsu, Numazu (JP)

(73) Assignee: KOKUSAN DENKI CO., LTD., Numazu (JP)

( * ) Notice: Subject to any disclaimer, the term of this patent is extended or adjusted under 35 U.S.C. 154(b) by 263 days.

(21) Appl. No.: 14/344,580

(22) PCT Filed: Sep. 14, 2012

(86) PCT No.: PCT/JP2012/005883

§ 371 (c)(1),
(2), (4) Date: Apr. 22, 2014

(87) PCT Pub. No.: WO2013/038697

PCT Pub. Date: Mar. 21, 2013

(65) Prior Publication Data

US 2014/0318488 A1 Oct. 30, 2014

(30) Foreign Application Priority Data

Sep. 14, 2011 (JP) ..... 2011-200543

(51) Int. Cl.

| | |
|---|---|
| ***F02P 5/00*** | (2006.01) |
| ***F02P 23/04*** | (2006.01) |
| ***F02P 1/08*** | (2006.01) |
| ***F02P 7/067*** | (2006.01) |
| *F02D 41/00* | (2006.01) |

(52) U.S. Cl.

CPC . *F02P 23/04* (2013.01); *F02P 1/08* (2013.01); *F02P 7/067* (2013.01); *F02D 41/0097* (2013.01); *F02D 2400/14* (2013.01)

(58) Field of Classification Search

CPC ..... F02P 1/086; F02P 11/025; F02P 5/1555; F02P 5/155; F02P 5/1506; F02P 5/1558; F02P 1/083; F02P 1/08; F02P 5/1556; F02P 3/0453; F02B 61/045; F02B 1/04

USPC ..... 123/406.11–406.76, 143 B, 149 D, 149 F, 123/620; 340/660; 361/86; 322/28; 310/70 A

See application file for complete search history.

(56) References Cited

FOREIGN PATENT DOCUMENTS

| | | | |
|---|---|---|---|
| JP | H01300200 | A | 12/1989 |
| JP | H03251933 | A | 11/1991 |
| JP | 2000-120517 | A | 4/2000 |
| JP | 2001-011224 | A | 1/2001 |
| JP | 2008-128058 | A | 6/2008 |
| JP | 2011-082176 | A | 4/2011 |
| JP | 2011-094558 | A | 5/2011 |

OTHER PUBLICATIONS

Microfilm of the specification and drawings annexed to the request of Japanese Utility Model Application No. 129524/1988 (Laid-open No. 50176/1990) (Tanaka Kogyo Co., Ltd.), Apr. 9, 1990, p. 12, line 3 to p. 15, line 3; fig. 3, 4 (Family: none).

*Primary Examiner* — Lindsay Low
*Assistant Examiner* — Syed O Hasan
(74) *Attorney, Agent, or Firm* — Pearne & Gordon LLP

(57) ABSTRACT

Provided is a control device for an internal combustion engine, employing a microprocessor to control a load other than an ignition device, the control device being provided to an internal combustion engine in which is installed a magnet generator that has a magneto coil for successively generating, in association with revolution of the internal combustion engine, a first half wave voltage, a second half wave voltage of different polarity than the first half wave voltage, and a third half wave voltage of identical polarity to the first half wave voltage; and the magnet generator employing the second half wave voltage to drive the ignition device. The device is provided with an electricity storage element which draws excess power from the output that is output by the magnet generator for the purpose of driving the ignition device, and which is charged by the first and second half wave voltages, as well as being charged by the second half wave voltage as well at times that the internal combustion engine is in the exhaust stroke, in order to supply power to the load and to the microprocessor. The power source circuit is constituted to use the energy stored in this electricity storage element to generate power source voltage for presentation to the microprocessor and to the load other than an ignition device.

10 Claims, 7 Drawing Sheets

CONTROL DEVICE FOR INTERNAL COMBUSTION ENGINE

TECHNICAL FIELD

The present invention relates to a control device for an internal combustion engine, the device using a microprocessor to control components to be controlled in the internal combustion engine.

BACKGROUND ART

In many instances, an internal combustion engine installed in a machine, such as a vehicle, ship, farming equipment, motor generator, or the like, is provided with a control device that uses a microprocessor to control particular components, such as machinery, belonging to the internal combustion engine. In a control device of this kind, a power source is necessary for operation of the microprocessor. Moreover, in cases in which a component to be controlled lacks a power source, it is necessary to supply a power source to the component to be controlled. Furthermore, in some cases, power is necessary for the operation of sensors as well.

In a case in which the generator attached to an internal combustion engine is a magnet generator of internal magnet type, provided with a rotor having a multitude of magnetic poles constituted by permanent magnets on the inside periphery of a fly wheel, and a stator having a constitution in which a plurality of magneto coils are wound onto a multipole armature core having magnetic pole sections opposing the magnetic poles of the rotor to the inside of the flywheel, and having, in addition to an ignition device-driving magneto coil for supplying power to the ignition device of the internal combustion engine, a load-driving magneto coil that produces surplus output, the microprocessor and the load to be controlled can be supplied with sufficient power by the output of the magnet generator. However, in a case in which, for the purpose of cost reduction or of smaller size/lighter weight of the engine, the generator attached to the engine is provided only with an ignition device-driving magneto coil, or in a case in which, despite being provided with an additional magneto coil, the additional magneto coil has a large load so as to produce no surplus output, it has sometimes proved difficult to supply sufficient power to the microprocessor and the load to be controlled.

Particularly when an ignition device-specific magnetic generator like that shown in Patent Document 1, which is provided with a rotor in which a single permanent magnet is attached to the outside periphery of a flywheel attached to the crankshaft of the internal combustion engine and in which are constituted three magnetic poles; and a stator in which a magneto coil for generating voltage to supply ignition energy to the ignition device of the internal combustion engine has been wound onto a core having magnetic pole sections opposing the magnetic poles of the rotor (herein, this type of magnet generator is termed an external magnet type magnet generator) is employed as the magnet generator installed in an internal combustion engine, it is problematic to ensure a power source for supplying power to the microprocessor and the like.

In an external magnet type magnet generator, alternating current voltage of a waveform having a first half wave voltage of one polarity, a second half wave voltage of another polarity generated following this first half wave voltage, and a third half wave voltage of the one polarity generated following this second half wave voltage, is generated once during each one revolution of the crankshaft. For reasons having to do with the structure of the rotor, the second waveform voltage is the voltage having the highest crest value among the first to third half waves generated by the external magnet type magnet generator, and therefore this second waveform voltage is employed for driving the ignition device of the internal combustion engine.

In some cases, the magneto coil of an external magnet type magnet generator is provided as the primary coil of the ignition coil constituting the internal combustion engine ignition device, and in other cases is provided as a separate magneto coil from the ignition coil. In a case in which the magneto coil of an external magnet type magnet generator is the primary coil of the ignition coil, in many instances, an ignition unit provided with constituent elements constituting the ignition coil as well as an ignition circuit, and constituent elements of an ignition control device for controlling the ignition circuit, is provided in an integrated state to the ignition coil provided to the stator.

In the above-described manner, in a case in which the generator attached to an internal combustion engine is an external magnet type magnet generator, because the generator is provided only with a magnetic coil for driving the ignition device, power is not supplied by the magnet generator to any load other than the ignition device. While it would be conceivable for the first half wave voltage and the third half wave voltage of identical polarity which are output before and after the second half wave voltage (the voltage for driving the ignition device) by the external magnet type magnet generator, to be utilized as voltages for driving a load besides the ignition device, for reasons having to do with the structure of the rotor, the crest values of the first half wave voltage and the third half wave voltage cannot be set very high, and therefore it is difficult using only these voltages to supply sufficient power to a microprocessor and a load to be controlled. Additionally, while it would be conceivable to utilize the second half wave voltage, which is employed for operating the ignition device, to supply power to a microprocessor and a load to be controlled, in a case in which such a constitution is adopted, there is insufficient energy to drive the ignition device, thereby making a decline in ignition performance unavoidable.

For this reason, in cases in which it is necessary to use a microprocessor to control specific machinery, other than the ignition device, which is to be controlled in an internal combustion engine, it was necessary to either prepare a battery of sufficient power capacity as a separate power source, as shown in Patent Document 2; or to employ as the generator attached to the internal combustion engine a large and expensive magnet generator of internal magnet type provided, in addition to the magneto coil for driving the ignition device, with a magneto coil capable of producing surplus output.

PRIOR ART DOCUMENTS

Patent Documents

[Patent Document 1] Japanese Laid-open Patent Application No. 2001-11224

[Patent Document 2] Japanese Laid-open Patent Application No. 11-82176

DISCLOSURE OF THE INVENTION

Problems to be Solved by the Invention

As described above, in cases in which a magnet generator installed in an internal combustion engine has only a magneto coil for driving the ignition device, or in cases in which, despite having an additional magneto coil besides the magneto coil for driving the ignition device, this magneto coil does not produce surplus output, it was difficult, using only the output of the magnet generator installed in the internal combustion engine, to supply sufficient power to a microprocessor and to loads, other than ignition device, that are to be controlled.

An object of the present invention is to provide a control device for an internal combustion engine, wherein in cases in which the magnet generator installed in an internal combustion engine has only a magneto coil for driving the ignition device, or in cases in which, despite having an additional magneto coil besides the magneto coil for driving the ignition device, this magneto coil is not able to produce surplus output, it is nevertheless possible to supply sufficient power to a microprocessor for controlling components to be controlled, and to other loads besides the ignition device; and to do so without affecting the ignition performance of the ignition device.

Means to Solve the Problems

The present invention relates to a control device for an internal combustion engine, employing a microprocessor to control a particular object to be controlled, the control device being provided to an internal combustion engine in which is installed a magnet generator having, an ignition device-driving magneto coil for induction of alternating current voltage in association with revolution of the internal combustion engine, the half wave voltage induced in the magneto coil being employed for presenting ignition energy to an ignition device for ignition of the internal combustion engine.

The control device for an internal combustion engine according to the present invention is provided with: a power source circuit having a power source electricity storage element, the power source circuit generating a power source voltage for presentation to the microprocessor and a power source voltage for presentation to a load other than the ignition device, from energy stored in the power source electricity storage element; an electricity storage element charging unit for charging the power source electricity storage element by the half wave induction voltage of the magneto coil employed for presenting ignition energy to the ignition device when a charge-enable signal is presented from the microprocessor; and a stroke determination unit for determining the stroke of the internal combustion engine. The microprocessor is programmed to generate a charge-enable signal when the stroke determination unit has determined that the stroke of the internal combustion engine is the exhaust stroke. The load other than the ignition device may be a component to be controlled by the microprocessor, or a load other than one to be controlled.

The ignition spark generated by the internal combustion engine ignition device during the exhaust stroke of the internal combustion engine is a wasted spark which is not employed for the purposes of combustion of fuel in the internal combustion engine, and therefore even when, among the half wave voltages induced by the magneto coil for driving the ignition device, the half wave voltage that presents ignition energy to the ignition device during the exhaust stroke of the internal combustion engine is utilized as voltage to supply power to the microprocessor for controlling a component to be controlled and to a load other than the ignition device, the ignition performance of the ignition device is unaffected. Because the half wave voltage that presents ignition energy to the ignition device has a high crest value, by charging the power source electricity storage element with this voltage, a large amount of energy can be stored in the power source electricity storage element, and the microprocessor and a load other than the ignition device can be supplied with power by the output of the ignition device-driving magneto coil, doing so without affecting the ignition performance of the ignition device.

As described above, in the present invention, considerable extra energy is drawn from the output of the ignition device-driving magneto coil provided to the magnet generator installed in the internal combustion engine, doing so without affecting the ignition performance of the ignition device. This extra energy is utilized effectively to supply power to microprocessor for controlling a component to be controlled, and to a load other than the ignition device, thereby preventing wasteful consumption of the output of the ignition device-driving magneto coil, so that power can be utilized effectively.

In the present invention, the magnet generator installed in the internal combustion engine has a magneto coil for inducing, in association with revolution of the crankshaft, alternating current voltage of a waveform having a first half wave voltage of one polarity, a second half wave voltage of another polarity, generated following the first half wave voltage, and a third half wave voltage of the one polarity, generated following the second half wave voltage; and is particularly useful in cases in which the second half wave voltage induced by the magneto coil is employed to present ignition energy to the ignition device for ignition of the internal combustion engine.

In a case in which a magnet generator is installed in an internal combustion engine in the above-described manner, the control device for an internal combustion engine according to the present invention has a configuration provided with: a power source circuit having a power source electricity storage element, the power source circuit for generating a power source voltage for presentation to the microprocessor and a power source voltage for presentation to a load other than the ignition device from energy stored in the power source electricity storage element; an electricity storage element charging unit having a first charging circuit for charging the power source electricity storage element by the first half wave voltage and the third half wave voltage induced in the magneto coil of the magnet generator, and a second charging circuit for charging the power source electricity storage element by the second half wave voltage induced in the magneto coil, when a charge-enable signal is presented from the microprocessor; and a stroke determination unit for determining the stroke of the internal combustion engine. In this case as well, the microprocessor is programmed to generate a charge-enable signal when the stroke determination unit has determined that the current stroke of the internal combustion engine is the exhaust stroke.

In the case of employing a magnet generator like that described above, because the second half wave voltage induced in the magneto coil has a high crest value, by charging the power source electricity storage element with this second half wave voltage, a large amount of energy can be stored in the power source electricity storage element. Moreover, by adopting a configuration like that described above, the power source electricity storage element is also charged by the first half wave voltage and the second half wave voltage induced in the magneto coil of the magnet generator, whereby a sufficiently large amount of energy can be stored in the power source electricity storage element, and power can be supplied to a microprocessor for controlling a particular object to be controlled, and to a load other than the ignition device, doing so without affecting the ignition performance of the ignition device for the internal combustion engine.

The present invention in a preferred embodiment thereof is further provided with: a load-driving switch circuit for controlling supply of drive current to a load to be controlled; and a switch circuit control unit for controlling the switch circuit in such a way as to disable supply of drive current to a component to be controlled, when the voltage at both ends of the power source electricity storage element has dropped to a set value set at or above the lower limit value of voltage necessary to sustain the microprocessor in the operational state.

The present invention in another preferred embodiment thereof is further provided with: a load-driving switch circuit for controlling supply of drive current to a load to be controlled; and a switch circuit control unit for controlling the switch circuit in such a way as to enable supply of drive current to a load, after generation of the first half wave voltage has been detected under a state in which the stroke of the internal combustion engine has been determined by the stroke determination unit to be in the exhaust stroke, and to disable supply of drive current to a load when the voltage at both ends of the power source electricity storage element has dropped to a set value which has been set at or above the lower limit value of voltage necessary to sustain the microprocessor in an operational state.

By adopting a configuration such as that described above, a situation in which a load is driven in a state of insufficient energy storage in the power source electricity storage element, causing the power source voltage of the power source circuit to drop to a voltage value at which operation of the microprocessor comes to a halt, whereby a state in which operation of the microprocessor comes to a halt, resulting in a loss of control, can be prevented.

The present invention in a preferred embodiment thereof is provided with a pressure sensor for detecting inlet pipe internal pressure of the internal combustion engine, and the stroke determination unit is constituted so as to determine, from a signal outputted by the pressure sensor, that the stroke of the internal combustion engine is in the exhaust stroke.

Typically, it is necessary for a pressure sensor to be presented with a power source voltage, in order to operate the pressure sensor. For this reason, the present invention in a preferred embodiment is provided with a sensor power source supply circuit for presenting to a pressure sensor from the power source circuit a power supply voltage necessary for operation of the pressure sensor, doing so when a power supply command is presented from the microprocessor; and a waveform processing circuit for converting the first half wave voltage and the third half wave voltage into a signal of a waveform recognizable by the microprocessor, and presenting the signal to the microprocessor. In this case, the microprocessor is programmed to monitor the voltage at either end of the power source electricity storage element, to detect the revolution speed of the internal combustion engine from the signal inputted from the waveform processing circuit, and to generate the power supply command when the voltage at either end of the power source electricity storage element exceeds a set value, and when additionally the revolution speed of the internal combustion engine exceeds a set value.

By adopting the aforedescribed constitution, situations in which power is supplied to the pressure sensor before a power source for the microprocessor has been set up, delaying activation of the microprocessor during startup of the internal combustion engine, can be prevented.

The aforedescribed power source electricity storage element may be a capacitor, such as an electrolytic capacitor, or a small battery.

Advantageous Effects of the Invention

According to the present invention, there is provided a power source electricity storage element that, during the exhaust stroke of the internal combustion engine, is charged by the half wave voltage generated by the ignition device-driving magneto coil for the purpose of presenting ignition energy to the ignition device; and the power source circuit is constituted such that power source voltage for presentation to the microprocessor and power source voltage for presentation to a load other than the ignition device are generated from the energy stored in this power source electricity storage element, whereby excess power can be effectively drawn from the ignition device-driving magneto coil provided to the generator installed in the internal combustion engine, and power can be supplied to the microprocessor and the load other than the ignition device, doing so with no effect on ignition operations.

BEST MODE FOR CARRYING OUT THE INVENTION

Figure 1:
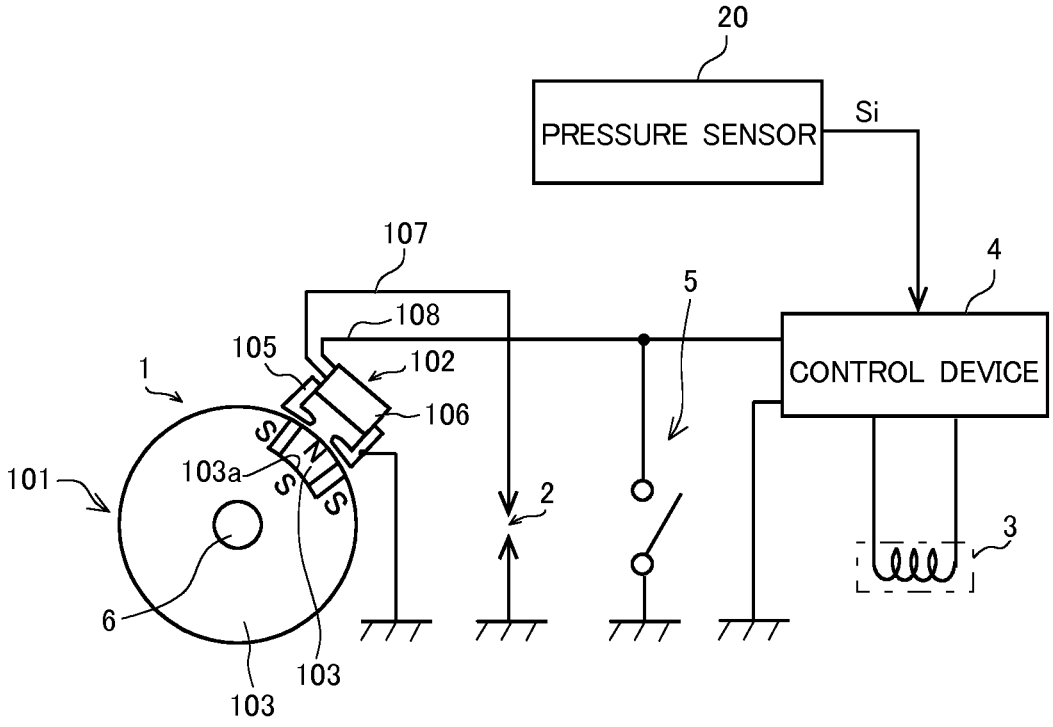
FIG. 1 is a configuration diagram showing the overall configuration of an embodiment of the control device according to the present invention.

Referring to FIG. 1, there is shown in simplified form the overall constitution of an embodiment of the present invention. In FIG. 1, 1 denotes an external magnet type magnet generator driven by an internal combustion engine; 2 denotes a spark plug mounted in a cylinder of the internal combustion engine; 3 denotes a load to be controlled; 4 denotes the control device for an internal combustion engine according to the present invention (hereinafter termed simply "control device"), and 5 denotes a stop switch which is switched to the ON state when halting the internal combustion engine. 20 denotes a pressure sensor for detecting internal pressure of the intake pipe of the internal combustion engine, and for outputting a pressure detection signal Si showing the internal pressure of the intake pipe. Alternating current voltage V1 output by the magnet generator and the pressure detection signal Si output by the pressure sensor 20 are input to the control device 4.

The external magnet type magnet generator 1 is composed of a rotor 101 and a stator 102. The rotor 101 is composed of a flywheel mounted onto a crankshaft 6 of the internal combustion engine, and permanent magnets 103*b* of arcuate shape secured at the bottom of recessed portions 103*a* provided to the outside periphery of the flywheel 103, and magnetized in the diametrical direction of the flywheel. In the rotor 101, a three-pole magnetic field is constituted by a magnetic pole (in the illustrated example, an N pole) at the outside peripheral side of the permanent magnets 103*b*, and two magnetic poles (in the illustrated example, S poles) elicited at either side of the recessed portions 103*a*.

The stator 102 is provided with a substantially U-shaped core 105 having at either end magnetic pole portions opposing the magnetic poles of the rotor; an ignition coil (not illustrated in FIG. 1) formed by winding a primary coil and a second coil onto the core 105; components constituting the ignition coil as well as the ignition circuit; and an ignition control unit for controlling the ignition circuit. The components constituting the ignition coil and the ignition circuit and the components constituting the ignition control unit have a structure integrally molded into a molded portion 106 composed of an insulating resin. A high-voltage cord 107 connected at one end to the non-ground side of the secondary coil of the ignition coil leads to the outside from the molded portion 106, and high voltage for ignition purposes induced in the secondary coil of the ignition coil during the ignition point of the internal combustion engine is applied through the high-voltage cord 107 to the spark plug 2 mounted in the cylinder of the internal combustion engine. In the present embodiment, the stator 102 of the external magnet type magnet generator 1 constitutes the ignition device for a single cylinder of the internal combustion engine.

The primary coil of the ignition coil provided to the stator of the external magnet type magnet generator 1 constitutes the magneto coil of the magnet generator 1, and alternating current voltage V1 is induced therein synchronously to revolution of the internal combustion engine. The ignition circuit provided inside the molded portion 106 induces high voltage for ignition purposes in the secondary coil of the ignition coil, through flow of the alternating current voltage induced in the primary coil, in the form of primary current to the ignition coil as a power source voltage for ignition purposes, and by producing a sudden change in this primary current during the ignition point of the internal combustion engine. The ignition control unit provided inside the molded portion 106 obtains crank angle information and revolution speed information about the internal combustion engine from the voltage induced in the primary coil of the ignition coil, and controls the point at which the ignition operation is conducted (the point at which the primary current of the ignition coil changes).

In the present embodiment, voltage at either end of the primary coil of the ignition coil is presented to the control device 4, for the purpose of drawing the power necessary to drive the microprocessor of the control device 4 and the load 3, and for the purpose of presenting revolution information about the internal combustion engine to the control device 4. In the present embodiment, one end of the primary coil (magneto coil) of the ignition coil provided to the stator of the external magnet type magnet generator 1 is grounded through connection to the core 105, while the other end of the primary coil is connected to the control device 4 through a lead wire 108 lead out from the molded portion 106.

The load 3 to be controlled by the control device 4 is an electrical load belonging to the internal combustion engine, wherein the load is a suitable one other than the ignition device. While any load can be to be controlled by the control device 4, in the present embodiment, the load 3 to be controlled is a solenoid for driving an electromagnetic valve provided to an electronic carburetor, for the purpose of controlling inflow of air to the carburetor, which supplies fuel to the internal combustion engine.

The stop switch 5 is a switch that is switched temporarily to the ON state when halting the internal combustion engine. One end thereof is grounded, while the other end is connected to a terminal on the ungrounded side of the primary coil of the ignition coil provided inside the molded portion 106 of the stator 102. By switching the stop switch 5 to the ON state and short-circuiting the primary coil of the ignition coil, operation of the ignition device is halted, halting the internal combustion engine.

Figure 2:
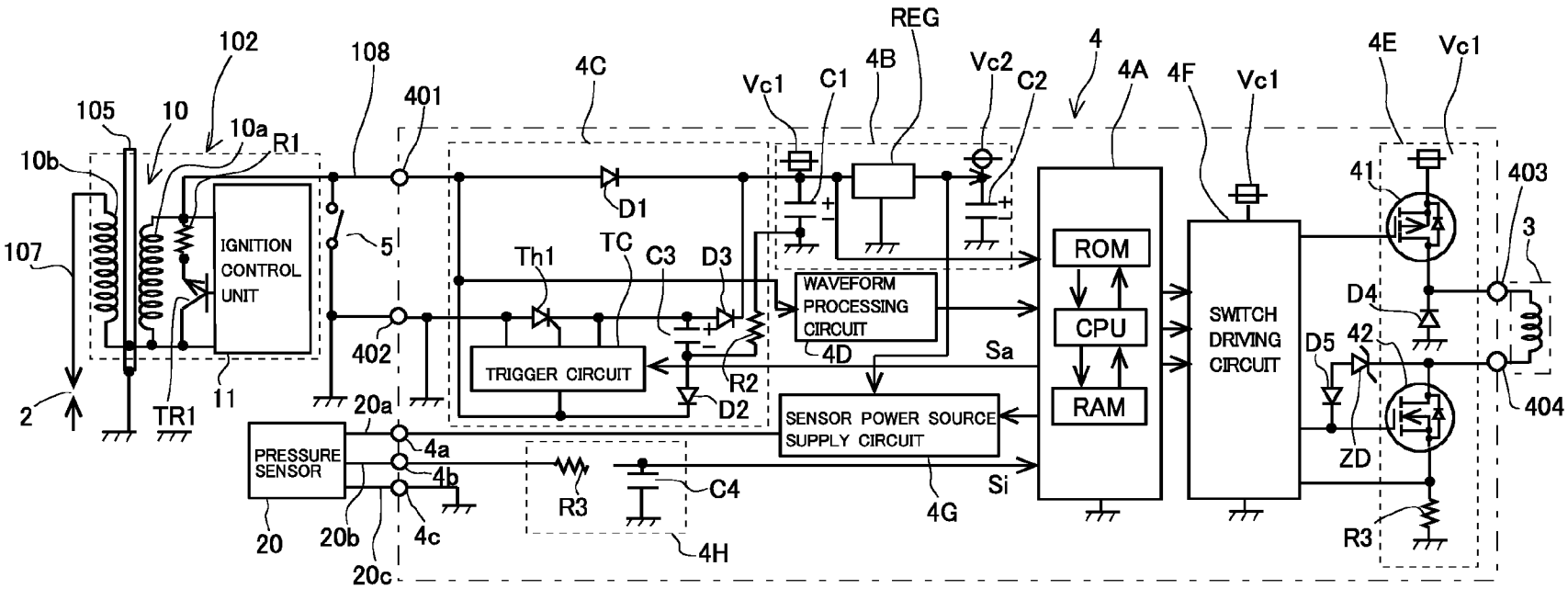
FIG. 2 is a circuit diagram showing a more specific configuration example of the control device according to the present invention.

Referring to FIG. 2, there are shown a configuration example of the ignition device provided to the stator 102 of the external magnet type magnet generator 1, and a configuration example of the control device 4. In FIG. 2, 10 denotes an ignition coil provided to the stator of the external magnet type magnet generator 1, and having a primary coil 10*a* and a second coil 10*b* which are wound onto the core 105. One end of the primary coil 10*a* is grounded through connection to the core 105, while the other end of the primary coil 10*a* is connected through a resistor R1 of low resistance, to the emitter of an NPN transistor TR1 having a grounded collector. The emitter, base, and collector of the transistor TR1 are connected to an ignition control unit 11. In this example, the ignition coil 10, the transistor TR1, and the resistor R1 constitute the ignition circuit, and this ignition circuit and the ignition control unit 11 constitute the ignition device for the internal combustion engine. One end of the secondary coil 10*b* of the ignition coil 10 is grounded through connection to the core 105, while the other end of secondary coil 10*b* is connected through the high-voltage cord 107 to a terminal at the ungrounded side of the spark plug 2 mounted in the cylinder targeted for ignition.

The primary coil 10*a* of the ignition coil serves simultaneously as the primary coil of the ignition coil and as the magneto coil of the external magnet type magnet generator 1. As shown schematically for example in FIG. 4 (B), this magneto coil, in association with revolution of the crankshaft of the internal combustion engine, outputs an alternating current voltage V1 of an asymmetric waveform having a first half wave voltage V11 of one polarity (in the illustrated example, positive polarity), a second half wave voltage V12 of another polarity (in the illustrated example, negative polarity) generated following this first half wave voltage, and a third half wave voltage V13 of the one polarity, generated following this second half wave voltage. For reasons having to do with the constitution of the magnetic poles of the rotor, the peak value of the second half wave voltage V12 is a large value, whereas the peak values of the first half wave voltage V11 and the third half wave voltage V13 are small values. On the horizontal axis in each of the diagrams shown in FIG. 3, "t" indicates elapsed time. This convention is employed also in the FIGS. 5 to 7 to be described later.

When the second half wave voltage V12 has been induced by the primary coil 10*a*, the ignition control unit 11 switches the transistor TR1 to the ON state, whereupon primary current flows from the primary coil 10*a* and through the collector and emitter of the transistor TR1 and the resistor R1, and when an ignition point of the internal combustion engine has been detected, switches the transistor TR1 to the OFF state, cutting off the primary current. By cutting off the current, high voltage is induced in the primary coil 10*a* of the ignition coil, and this voltage is boosted by the boost ratio between the primary and secondary [windings] of the ignition coil, inducing high voltage for ignition purposes in the secondary coil 10*b*. This high voltage is then applied to the spark plug 2 through the high voltage cord 107, thereby producing a spark discharge from the spark plug 2, and igniting the internal combustion engine.

The control device 4 has a ungrounded-side power source input terminal 401 and a grounded-side power source input terminal 402; sensor connection terminals 4*a*, 4*b*, and 4*c* respectively connected to a plus-side power source terminal 20*a*, an output terminal 20*b*, and a ground terminal 20*c* of the pressure sensor 20; and a plus-side output terminal 403 and a minus-side output terminal 404 to which the load 3 is connected. The ungrounded-side power source input terminal 401 of the control device 4 is connected through the lead wire 108 to the ungrounded-side terminal of the primary coil (magneto coil) 10*a*, while the grounded-side power source input terminal 402 is grounded together with the ground-side terminal of the stop switch 5. In so doing, the alternating current voltage V1 induced in the primary coil 10*a* is input to the control device 4.

The control device 4 includes: a microprocessor 4A; a power source circuit 4B for using the energy stored in a power source electricity storage element C1 to generate a power source voltage for supply to the microprocessor 4A, to the load 3, and the like; an electricity storage element charging unit 4C for using the induced voltage from the primary coil 10*a* to charge the power source electricity storage element C1 of the power source circuit 4B; a waveform processing circuit 4D for converting the first half wave voltage V11 and the third half wave voltage V13 which have been induced in the primary coil 10*a*, into signals of a waveform recognizable by the microprocessor, and presenting the microprocessor 4A with a crank angle signal including information about the crank angle of the internal combustion engine; a load-driving switch circuit 4E for ON/OFF [control] of drive current supplied to the load 3; a switch driving circuit 4F for presenting a drive signal (a signal for switching a switch element to the ON state) to a switch element constituting the load-driving switch circuit 4E, for ON/OFF control of drive current supplied to the load 3; a sensor power source supply circuit 4G for presenting power source voltage to the pressure sensor 20 for detecting pressure inside the inlet pipe (manifold vacuum) of the internal combustion engine; and a low-pass filter 4H for noise elimination, provided between the output terminal 20*b* of the pressure sensor 20 and the input port of the microprocessor 4A.

The microprocessor 4A is an arithmetic processing device of chip form in which constituent elements such as the CPU, storage devices such as ROM, RAM, and the like, and input/output circuits are subsumed within an integrated circuit, and constitutes function blocks for accomplishing various functions, through execution of a program stored in ROM. The microprocessor 4A is presented with a constant voltage Vc2 as a power source voltage by the power source circuit 4B, and receives input of the voltage Vc1 at either end of the power source electricity storage element C1 of the power source circuit, the output of the waveform processing circuit 4D, and the output of the pressure sensor 20, as control information.

The power source circuit 4B includes the power source electricity storage element C1 which is grounded at one end and charged with induced voltage from the primary coil 10*a* through the electricity storage element charging unit 4C, and an output capacitor C2 which is charged to a constant voltage by the voltage at either end of the power source electricity storage element C1, through a regulator REG; and uses energy stored in the power source electricity storage element C1 to generate power source voltage for supply to the various units of the control device, the pressure sensor 20, and the load 3. The illustrated regulator REG is a regulator for converting the voltage Vc1 at either end of the power source electricity storage element C1 to a constant (e.g. 5 V) voltage Vc2 suitable as power source voltage for the microprocessor 4A and the like, and controls the voltage Vc2 at either end of the output capacitor C2 in such a way as to maintain a constant setting. In order for the regulator REG to perform control in order to maintain the voltage Vc2 at either end of the output capacitor C2 at a constant setting, it is necessary for the voltage Vc1 at either end of the power source electricity storage element C1 to be at or above the voltage Vc2 setting. In the illustrated example, the voltage Vc1 at either end of the power source electricity storage element C1 of the power source circuit 4B is presented as power source voltage to the switch driving circuit 4F and to the load 3. The constant voltage Vc2 obtained at either end of the output capacitor C2 is presented to the power source terminal of the microprocessor 4A, as well as being presented to the power source terminal 4*a* of the pressure sensor 20 through the sensor power source supply circuit 4G.

The electricity storage element charging unit 4C is composed of a circuit including: a first diode D1 connected at the anode thereof through the ungrounded-side power source input terminal 401 to a terminal on the ungrounded side of the primary coil 10*a*, and connected at the cathode thereof to a terminal on the ungrounded side of the power source electricity storage element C1; a thyristor Th1 connected at the anode thereof to the grounded-side power source input terminal 402; a capacitor C3 connected at one end thereof to the cathode of the thyristor Th1; a second diode D2 connected at the anode thereof to the other end of the capacitor C3, and connected at the cathode thereof to the ungrounded-side power source input terminal 401; a third diode D3 connected at the anode thereof to one end of the capacitor C3, and connected at the cathode thereof to a terminal on the ungrounded side of the power source electricity storage element C1; a resistor R2 connected between the other end of the capacitor C3 and the terminal on the grounded side of the power source electricity storage element C1; and a trigger circuit TC for presenting a trigger circuit to the gate of the thyristor Th1 when a charge-enable signal is presented from the microprocessor 4A.

In this electricity storage element charging unit 4C, a first charging circuit is constituted by a circuit including the power source input terminal 401, the diode D1, the electricity storage element C1, a ground circuit, and the power source input terminal 402. When the first half wave voltage V11 is induced, or when the third half wave voltage V13 is induced, in the magneto coil (primary coil) 10*a* of the external magnet type magnet generator 1, the power source electricity storage element C1 is charged to the illustrated polarity, through the aforedescribed first charging circuit.

In the electricity storage element charging unit 4C, when the gate of the thyristor Th1 is presented with a trigger signal and the thyristor Th1 enters the ON state due to the trigger circuit TC being presented with a charge-enable signal by the microprocessor 4A, the capacitor C3 is charged to the illustrated polarity by the second half wave voltage V12 output by the magneto coil 10*a* of the external magnet type magnet generator 1. When the voltage at either end of the capacitor C3 is higher than the voltage at either end of the power source electricity storage element C1, charges stored in the capacitor C3 migrate to the power source electricity storage element C1 through the diode D3, whereby the power source electricity storage element C1 is charged to the illustrated polarity. In the present embodiment, a second charging circuit for using the second half wave voltage induced in the magneto coil 10*a* to charge the power source electricity storage element C1 when a charge-enable signal is presented from the microprocessor 4A is constituted by a circuit including the power source input terminal 402, the thyristor Th1, the capacitor C3, the diode D2, and the power source input terminal 401; and by a closed circuit including the capacitor C3, the diode D3, the power source electricity storage element C1, the resistor R2, and the capacitor C3.

Figure 4:
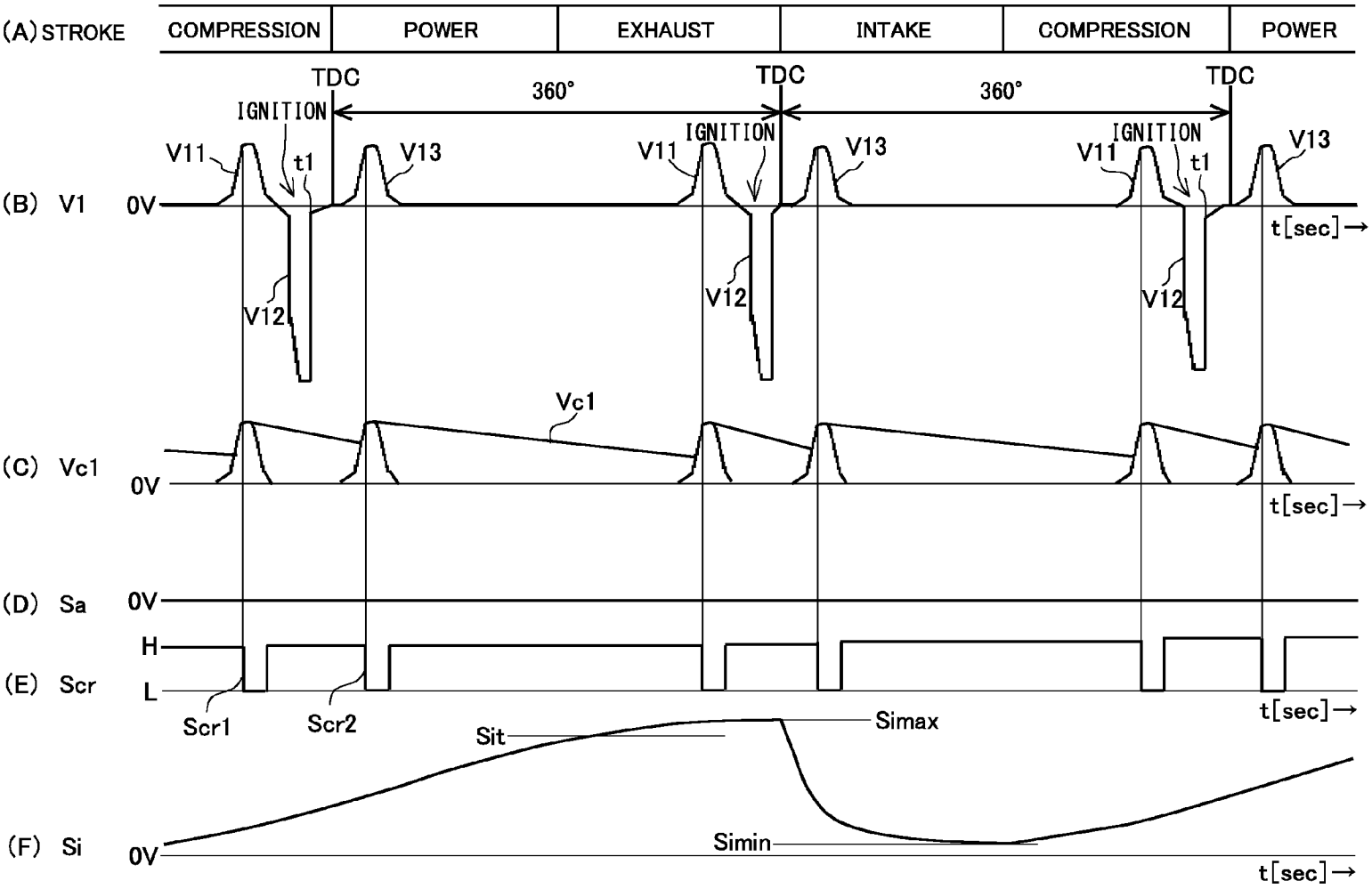
FIG. 4 is a timing chart showing operations of units of the control device in the embodiment of FIG. 2, in a case in which the power source electricity storage element is not being charged by a half wave voltage generated by the external magnet type magnet generator in order to obtain ignition energy, and moreover no load is being driven, wherein (A) is a timing chart showing change of the stroke of the internal combustion engine, (B) is a timing chart showing the timing of output of half wave waveforms by the generator, (C) is a timing chart showing change of voltage at either end of the electricity storage element, (D) is a timing chart showing the timing of generation and extinction of a charge-enable signal output by the microprocessor, (E) is a timing chart showing the timing of generation and extinction of a crank angle detection signal output by the microprocessor, and (F) is a timing chart showing change of an output signal of the pressure sensor.

The waveform processing circuit 4D is a circuit for waveform shaping of the first half wave voltage V11 and the third half wave voltage V13 output by the external magnet type magnet generator 1, converting these into signals of a waveform able to be recognized by the microprocessor. In the present embodiment, the waveform processing circuit 4D converts the first half wave voltage V11 and the third half wave voltage V13 respectively into a first crank angle signal Scr1 and a second crank angle signal Scr2 of rectangular shape as shown in FIG. 4 (E).

The first crank angle signal Scr1 is a signal that falls from H level (High level) to L level (Low level) when the first half wave voltage V11 reaches a threshold value, and that rises from L level to H level when the first half wave voltage V11 is less than the threshold value. The second crank angle signal Scr2 is a signal that falls from H level to L level when the third half wave voltage V13 reaches a threshold value, and that rises from L level to H level when the first half wave voltage V11 is less than the threshold value. The first and second crank angle signals are employed as signals to detect that the crank angle of the internal combustion engine matches a set crank angle position.

The aforedescribed set crank angle position is determined by the position at which the stator of the external magnet type magnet generator 1 is arranged. In the present embodiment, as shown in FIG. 4 (B), the position of the stator of the external magnet type magnet generator 1 is set such that the first crank angle signal Scr1 is generated at a crank angle position of advanced phase relative to the maximum advance position of the ignition position (the crank angle position at which ignition takes place) of the cylinder targeted for ignition by the ignition device, and such that the second crank angle signal Scr2 is generated at a crank angle position of slightly delayed phase relative to the crank angle position when the piston inside the cylinder targeted for ignition has reached top dead center (also called the top dead center position) TDC. The position for generating the first crank angle signal Scr1 (a position at which the first half wave voltage V11 is at or above the threshold value) is employed as the position to initiate measurement of the ignition position of the internal combustion engine. At a position at which the first half wave voltage V11 is at or above the threshold value, the ignition control unit 11 of the ignition device for an internal combustion engine initiates measurement of an ignition position computed with respect to a control parameter, such as the revolution speed of the internal combustion engine or the like, and when measurement thereof has completed (at timing t1 shown in FIG. 4B), switches the transistor TR1 to the OFF state and performs an ignition operation.

The waveform processing circuit 4D may, for example, be constituted by a circuit including a transistor presented with base current by the first half wave voltage V11 and the third half wave voltage V13, and that enters a periodic ON state when the first half wave voltage V11 and the third half wave voltage V13 are respectively equal to or greater than the threshold value, while entering the OFF state when the first half wave voltage V11 and the third half wave voltage V13 are less than the threshold value, the crank angle signal being obtained between the collector and the emitter of the transistor.

The load-driving switch circuit 4E is a switch circuit for ON/OFF [control] of drive current supplied to the load. The illustrated load-driving switch circuit 4E is a circuit including: an upper stage MOSFET 41 of P-channel type connected at the source to the terminal on the ungrounded side of the power source electricity storage element C1 of the power source circuit 4B, and connected at the drain to one end of the load 3; a lower stage MOSFET 42 of N-channel type connected at the drain to the other terminal of the load, and grounded at the source through a shunt resistor R3; a flywheel diode D4 connected such that the anode faces towards the ground side, between one end of the load 3 and the ground; a zener diode ZD connected at the cathode to the drain of the MOSFET 42; and a diode D5 connected such that the anode faces towards the zener diode ZD, between the anode of the zener diode ZD and the gate of the MOSFET 42. In the illustrated load-driving switch circuit, the upper stage MOSFET 41 is employed to control the drive current supplied to the load 3. The lower stage MOSFET 42 is employed as a switch for deciding to either to drive the load 3, or halt drive of the load 3. The MOSFET 42 is maintained in a periodic ON state for drive of the load 3, or maintained in a periodic OFF state for halting drive of the load 3.

The switch-driving circuit 4F is a circuit for presenting a drive signal to the MOSFET constituting the load-driving switch circuit 4E, and when presented with a load drive command from the microprocessor 4A, presents a drive signal to the gate of the lower stage MOSFET 42 so as to maintain the MOSFET 42 in the ON state, as well as presenting a drive signal for ON/OFF [control] of the upper stage MOSFET 41 to the gate of the MOSFET 41, in order to maintain the average value of the load current detected at either end of the resistor R3 at a set value.

The sensor power source supply circuit 4G is a circuit for presenting power source voltage to the pressure sensor 20, and when presented by the microprocessor 4A with a power source supply command, supplies the voltage Vc2 at either end of the output capacitor C2 of the power source circuit 4B to between the power source terminals 4*a*, 4*c* of the pressure sensor 20. The sensor power source supply circuit 4G can be constituted by a switch circuit that assumes the ON state while being presented with a power source supply command from the microprocessor 4A.

Figure 3:
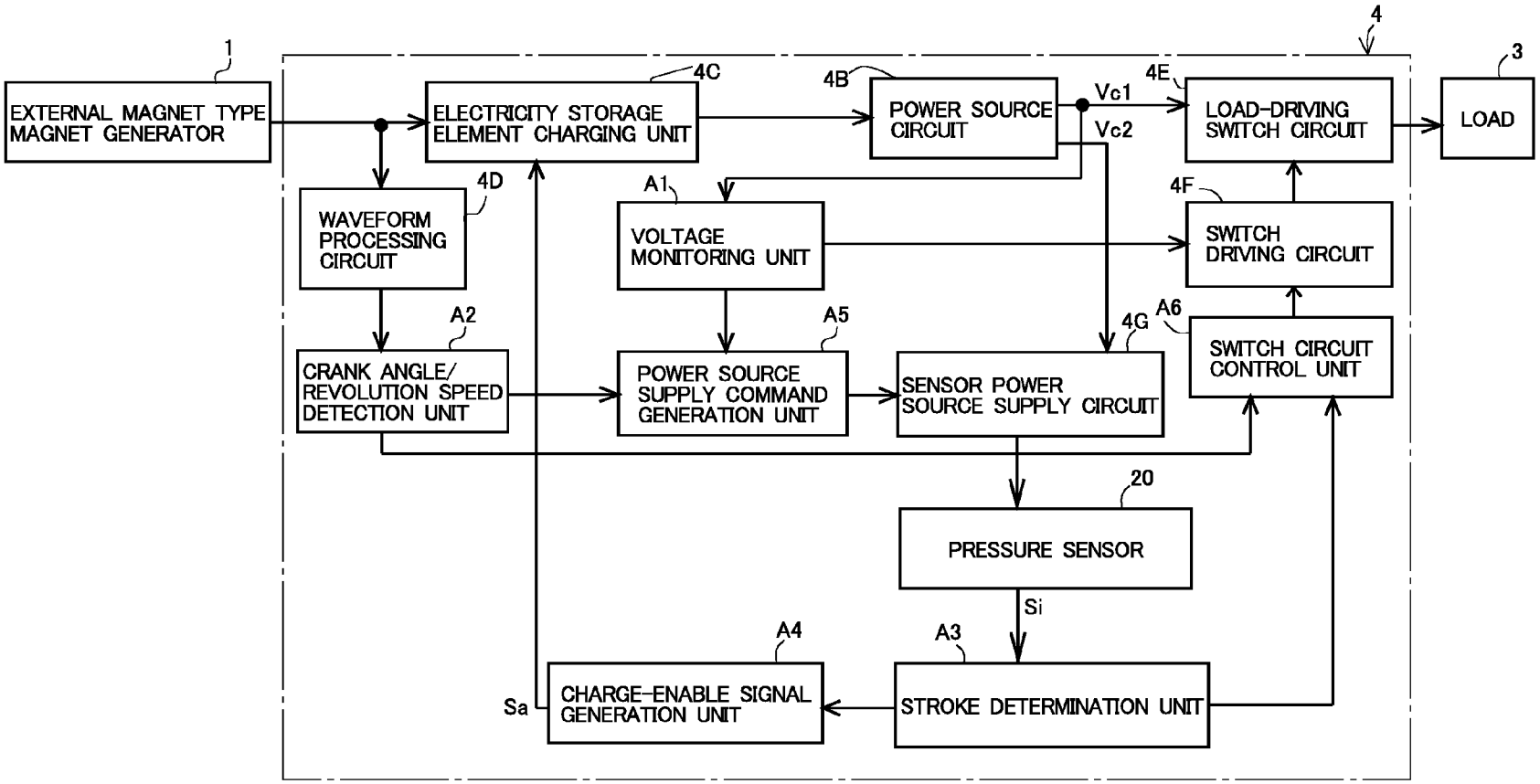
FIG. 3 is a block diagram showing a configuration of function blocks constituted by the microprocessor in the control device shown in FIG. 2.

FIG. 3 shows the function blocks constituting the microprocessor 4A in the present embodiment, together with sections constituted by hardware circuitry. Through execution of a predetermined program, the microprocessor 4A constitutes a voltage monitoring unit A1, a crank angle/revolution speed detection unit A2, a stroke determination unit A3, a charge-enable signal generation unit A4, a power source supply command generation unit A5, and a switch circuit control unit A6. These units are described below.

The voltage monitoring unit A1 is constituted to compare the voltage Vc1 at either end of the power source electrical storage element C1 of the power source circuit 4B to a set voltage value, and to determine whether the voltage Vc1 is at or above the voltage value necessary to operate the pressure sensor 20 without having to halt operation of the microprocessor 4A, as well as to determine whether the voltage Vc1 is at or above a set value that has been set at or above the lower limit value of voltage necessary to sustain the microprocessor in an operational state. The lower limit value of the voltage Vc1 is set to be slightly higher than a voltage value at which the output voltage Vc2 of the power source circuit can be maintained at a constant value suitable as the power source voltage for the microprocessor.

The crank angle/revolution speed detection unit A2 is constituted to detect, from a signal input through the waveform processing circuit 4D, that the crank angle of the internal combustion engine matches a specific crank angle, as well as to detect the revolution speed of the internal combustion engine, from the gap between the first half wave voltage and the third half wave voltage. The crank angle/revolution speed detection unit A2 can be constituted, for example, by microprocessor execution of a process including a step of reading out a measurement from a free running timer when the first crank angle signal Scr1 is input from the waveform processing circuit 4D, a step of reading out a measurement from the free running timer when the second crank angle signal Scr2 is input, and a step of computing the revolution speed of the engine, from the difference between the timer measurement read out when the second crank angle signal Scr2 was input and the timer measurement read out when the first crank angle signal Scr2 was input, doing so every time that the first crank angle signal Scr1 and the second crank angle signal Scr2 are generated.

From the internal pressure of the intake pipe detected by the pressure detector 20, the stroke determination unit A3 determines that the stroke of the internal combustion engine is in the exhaust stroke. As shown for example in FIG. 4 (F), the pressure sensor 20 outputs a pressure detection signal Si showing the internal pressure of the intake pipe. A lower value for the pressure detection signal Si corresponds to a lower internal pressure of the intake pipe (a higher absolute value of the manifold vacuum), and a higher value for the pressure detection signal Si corresponds to a higher internal pressure of the intake pipe. After the internal pressure of the intake pipe of the internal combustion engine has shown its lowest value during the intake stroke, it gradually rises to reach substantially atmospheric pressure at top dead center (TDC) in the exhaust stroke, and thereafter drops sharply towards the minimum value in the intake stroke. Consequently, as seen in FIG. 4 (F), the pressure detection signal Si, after showing its minimum value Simin during the intake stroke, rises gradually to show its maximum value Simax at top dead center (TDC) in the exhaust stroke, then drops sharply towards the minimum value Simin during the intake stroke. This pattern of change in the pressure detection signal can be utilized to determine that the stroke of the internal combustion engine is in the exhaust stroke.

For example, when comparing the pressure detection signal Si to a threshold value Sit, once the level of the pressure detection signal Si has reached the threshold value Sit or above, the internal combustion engine stroke can be determined to be in the exhaust stroke, for a period until reaching the maximum value Simax. Additionally, once the minimum value Simin of the pressure detection signal Si has been observed, if after detecting that the external magnet type magnet generator 1 has generated the first half wave voltage V11 and the third half wave voltage V13, the first half wave voltage V11 is again detected to have been generated (i.e., when after the minimum value Simin of the pressure detection signal Si has been observed, it is detected that the external magnet type magnet generator has generated three positive polarity voltages), the internal combustion engine stroke can be determined to be in the exhaust stroke. There are various methods known for utilizing the pattern of change of the manifold vacuum to determine the stroke of an internal combustion engine, and therefore a detailed discussed is omitted here.

The charge-enable signal generation unit A4 is constituted to generate a charge-enable signal Sa when the stroke determination unit A3 has determined that the internal combustion engine stroke is in the exhaust stroke. The charge-enable signal generation unit A4 may be realized, for example, through microprocessor execution, at constant time intervals, of a process that includes a step of verifying whether the stroke determination unit A3 has determined that the internal combustion engine stroke is in the exhaust stroke; a step of outputting a charge-enable signal from the output port of the microprocessor, when it has been verified in this step that the internal combustion engine stroke is in the exhaust stroke; and a step of extinguishing the charge-enable signal when verified that the exhaust stroke of the internal combustion engine has completed (or that the engine has transitioned from the exhaust stroke to the intake stroke). The charge-enable signal Sa generated by the charge-enable signal generation unit A4 is presented to the electricity storage element charging unit 4C.

The power source supply command generation unit A5 is constituted to generate a power source supply command when the voltage Vc1 at either end of the power source electricity storage element C1, which is monitored by the voltage monitoring unit A1, exceeds a set value, and when additionally the revolution speed detected by the crank angle/revolution speed detection unit A2 exceeds a set value. The power source supply command generation unit A5 may be realized for example, through microprocessor execution, at constant time intervals, of a process that includes a step of determining whether the voltage Vc1 at either end of the power source electricity storage element C1 exceeds a set value; a step of determining whether the revolution speed exceeds a set value; a step of generating a power source supply command from the output port of the microprocessor A4 when it has been determined that the voltage Vc1 exceeds the set value, and moreover that the revolution speed exceeds the set value; and a step of extinguishing the power source supply command when it has been determined that the voltage Vc1 has fallen to or below the set value, or that the revolution speed has fallen to or below the set value.

In the aforedescribed manner, by furnishing the sensor power source supply circuit 4G for presenting power source voltage to the pressure sensor 20 when presented with a power source supply command, monitoring the voltage Vc1 at either end of the power source electricity storage element C1, detecting the revolution speed of the internal combustion engine from the signal input from the waveform processing circuit 4D, and presenting a power source supply command from the microprocessor 4A to the sensor power source supply circuit 4G when the voltage Vc1 at either end of the power source electricity storage element exceeds a set value, and when moreover the revolution speed exceeds a set value, situations in which power is supplied to the pressure sensor 20 before a power source for the microprocessor has been set up, delaying activation of the microprocessor during startup of the internal combustion engine, can be prevented.

From a state in which the stroke determination unit A3 has determined that the internal combustion engine stroke is in the exhaust stroke, once it has been detected that the first half wave voltage V11 has been generated, the switch circuit control unit A6 enables supply of drive current to the load 3, while controlling the supply of a drive signal from the switch driving circuit 4F to the load-driving switch circuit 4E in such a way as to disable the supply of drive current to the load 3 when the voltage Vc1 at either end of the power source electricity storage element C1 has dropped to a set value set at or above the lower limit value of voltage necessary to sustain the microprocessor 4A in an operational state, to control the switch circuit 4E in such a way as to supply the load 3 with power in such a range that the microprocessor 4A can be sustained in an operational state.

The microprocessor 4A further constitutes a control block for controlling the load 3 (in the present embodiment, a solenoid for driving an electromagnetic valve of an electronic carburetor); however, in the present invention, the load 3 controlled by the control device 4 and the specifics of control are discretionary.

In the control device 4 for an internal combustion engine according to the present embodiment, the power source electricity storage element C1 is charged through the electricity storage element charging unit 4C when the first half wave voltage V11 and the third half wave voltage V13 have been induced in the magneto coil 10*a*. In a state in which the microprocessor 4A is generating a charge-enable signal during the exhaust stroke of the internal combustion engine, when the second half wave voltage V12 has been induced in the magneto coil 10*a*, the power source electricity storage element C1 is charged through the electricity storage element charging unit 4C by the second half wave voltage V12 of a high crest value, which is induced in the magneto coil 10*a*. Because the ignition spark generated by the internal combustion engine ignition device during the exhaust stroke of the internal combustion engine is not employed to combust fuel in the internal combustion engine, the ignition performance of the ignition device is unaffected, in spite of the fact that the power source electricity storage element C1 is charged by the second half wave voltage V12 induced in the magneto coil 10*a* of the magnet generator 1 during the exhaust stroke of the internal combustion engine, and that the energy stored in this storage element is used to supply power to the microprocessor 4A and to the load 3 to be controlled.

In this way, according to the present embodiment, considerable extra energy can be drawn from the magneto coil 10*a* that drives the ignition device, doing so with no effect whatsoever on the ignition operation of the ignition device, to supply power to the load 3 to be controlled and to the microprocessor that controls the load 3, whereby in cases in which the generator installed in the internal combustion engine is a magnetic generator that includes only a magneto coil for driving the ignition device, or in cases in which, despite having an additional magneto coil besides the magneto coil for driving the ignition device, no surplus output is available, the microprocessor 4A and the load 3 other than the ignition device can be operated with no trouble nevertheless, without the need to employ an additional power source, and with no effect on ignition operations.

FIG. 4 is a timing chart showing operation of the units of the control device 4 in the embodiment of FIG. 2, in a case in which the power source electricity storage element C1 is charged by the first half wave voltage V11 and the third half wave voltage V13 induced in the magneto coil 10*a*, but the power source electricity storage element C1 is not charged by the second half wave voltage V12 (a case in which the charge-enable signal Sa is not generated), and in which driving of the load 3 is not performed. In FIG. 4, (A) is a timing chart timing chart showing change of the stroke of the internal combustion engine, and (B) to (F) are timing charts respectively showing the output voltage V1 of the generator 1, the voltage Vc1 at either end of the power source electricity storage element C1, the charge-enable signal Sa output by the microprocessor 4A, the crank angle detection signal Scr input to the microprocessor, and the output signal Si of the pressure sensor 20.

In the control device shown in FIG. 2, in a case in which the charge-enable signal Sa is not generated and the power source electricity storage element C1 is not charged by the second half wave voltage V12, as shown in FIG. 4 (B), the power source electricity storage element C1 is charged respectively when the magneto coil 10*a* of the external magnet type magnet generator 1 has generated the first half wave voltage V11 in the latter half of the compression stroke, when it has generated the third half wave voltage V13 in the initial period of the power stroke, when it has generated the first half wave voltage V11 in the latter half of the exhaust stroke, and when it has generated the third half wave voltage V13 in the initial period of the intake stroke. In this case, the voltage Vc1 at either end of the power source electricity storage element C1 changes as shown in FIG. 4 (C). In this way, in a case in which the power source electricity storage element C1 is not charged by the second half wave voltage V12, the power source electricity storage element C1 is only charged to the peak value of the first half wave voltage V11 and the third half wave voltage V13, which have low values, and therefore the voltage Vc1 at either end of the power source electricity storage element C1 cannot become sufficiently high. In the example shown in FIG. 4, because the load 3 is not being driven, the voltage Vc1 does not drop significantly, and power source voltage is supplied to the microprocessor 4A from the power source circuit 4B with no trouble.

Figure 5:
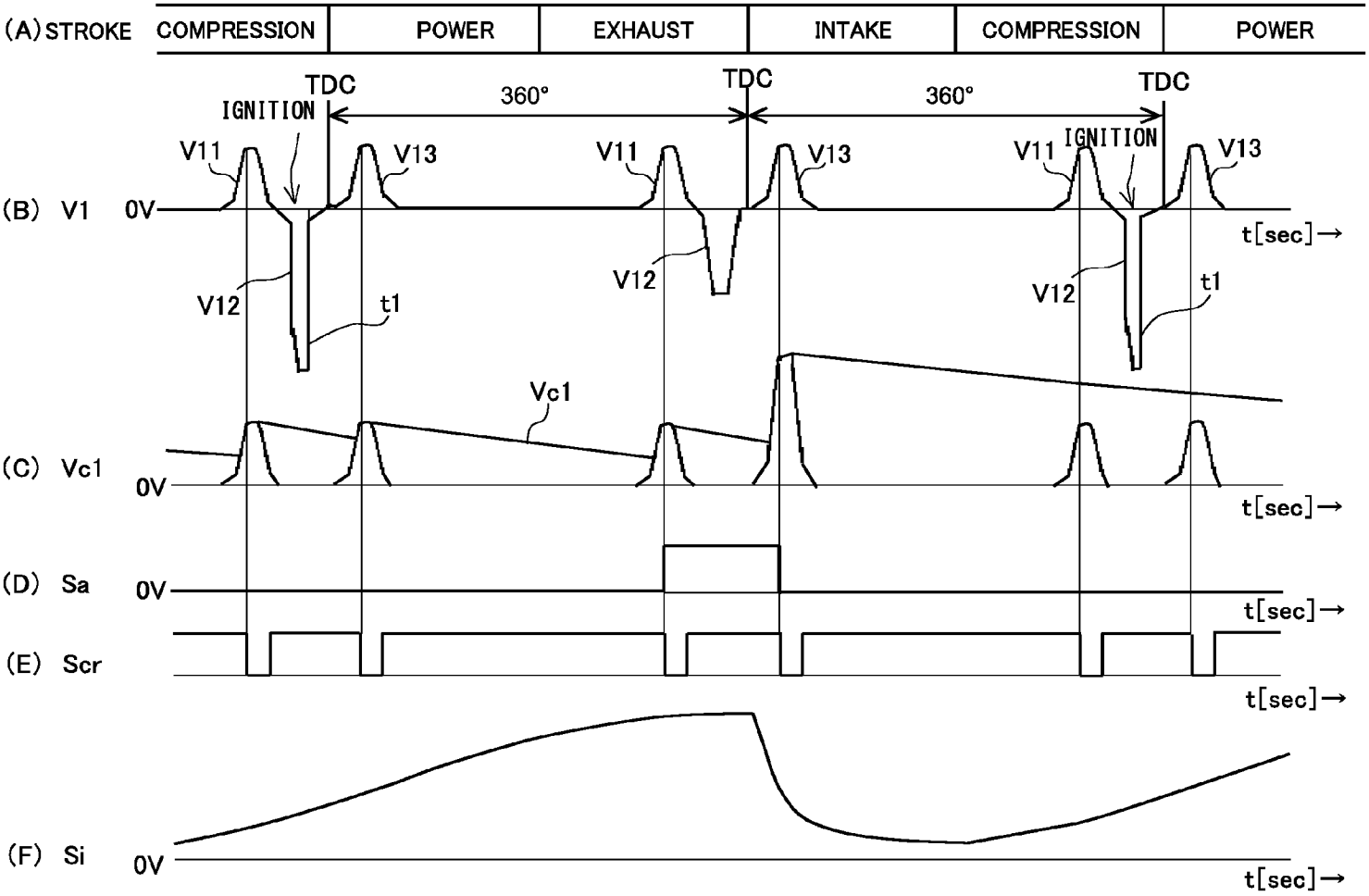
FIG. 5 is a timing chart showing operations of units of the control device in the embodiment of FIG. 2, in a case in which the power source electricity storage element is being charged by a half wave voltage generated by the external magnet type magnet generator, in order to obtain ignition energy, but no load is being driven, wherein (A) is a timing chart showing change of the stroke of the internal combustion engine, (B) is a timing chart showing the timing of output of half wave waveforms by the generator, (C) is a timing chart showing change of voltage at either end of the electricity storage element, (D) is a timing chart showing the timing of generation and extinction of a charge-enable signal output by the microprocessor, (E) is a timing chart showing the timing of generation and extinction of a crank angle detection signal output by the microprocessor, and (F) is a timing chart showing change of an output signal of the pressure sensor.

In contrast to this, in a case like that shown in FIG. 5 (D), in which the charge-enable signal Sa is generated in the final period of the exhaust stroke, and the thyristor Th1 of the electricity storage element charging unit 4C enters the ON state when the generator generates the second half wave voltage V12 to thereby charge the capacitor C3 from the magneto coil 10*a* through the thyristor Th1, and thereafter charge migrates from the capacitor C3 to the power source electricity storage element C1 so that the power source electricity storage element C1 is charged by the second half wave voltage V12 as well, the power source electricity storage element C1 becomes charged to a high voltage as shown in FIG. 5 (C). In a case in which the thyristor Th1 of the electricity storage element charging unit 4C enters the ON state when the magnet generator 1 has generated the second half wave voltage V12, and current from the magneto coil 10*a* has been absorbed by the electricity storage element charging unit 4C, the flow of primary current w through the transistor TR1 is not sufficiently large for the ignition operation to be performed, so there is no firing unnecessarily during the exhaust stroke.

Figure 6:
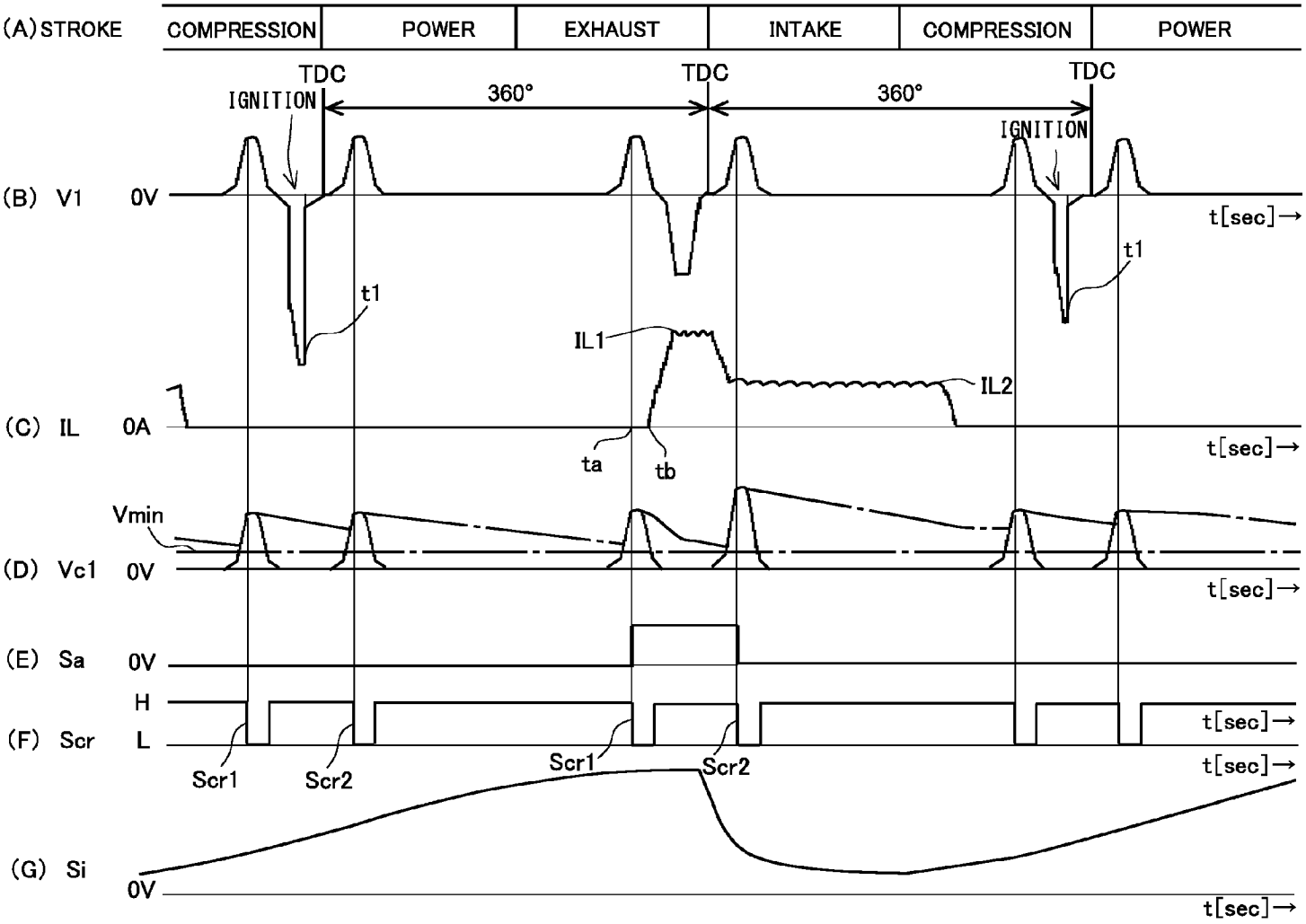
FIG. 6 is a timing chart showing operations of units of the control device in the embodiment of FIG. 2, when the power source electricity storage element is being charged by half wave voltages generated by the external magnet type magnet generator, in order to obtain ignition energy, and a load is being driven at appropriate timing, wherein (A) is a timing chart showing change of the stroke of the internal combustion engine, (B) is a timing chart showing the timing of generation of half wave waveforms by the generator, (C) is a timing chart showing change of negative current, (D) is a timing chart showing change of voltage at either end of the electricity storage element, (E) is a timing chart showing the timing of generation and extinction of a charge-enable signal input to the microprocessor, (F) is a timing chart showing the timing of change of a crank angle detection signal output by the microprocessor, and (G) is a timing chart showing change of an output signal of the pressure sensor.

FIG. 6 shows the voltage waveforms of each unit, and the load current waveform, in a case in which the load 3 is driven, from a state in which the power source electricity storage element C1 is charged by the first half wave voltage V11 and the third half wave voltage V13 and the charge-enable signal Sa is generated in the final period of the exhaust stroke, so that the power source electricity storage element C1 is charged by the second half wave voltage V12 output by the generator in the exhaust stroke as well. As mentioned previously, in the present embodiment, the load 3 is the solenoid of an electromagnetic valve for controlling the supply of air to the electronic carburetor.

In the example shown in FIG. 6, selecting, as the timing for initiating driving of the load, a timing tb that immediately follows a timing to at which the first half wave voltage V11 is equal to or greater than the threshold value during the exhaust stroke and at which the first crank angle signal Scr1 is generated (i.e., a timing that immediately precedes initiation of charging of the power source electricity storage element C1 by the second half wave voltage V12), the switch driving circuit 4F is presented with a load drive command from the microprocessor 4A at this timing for initiating driving of the load. Therefore, at timing tb, the MOSFET of the load-driving switch circuit 4E enters the ON state, whereby the voltage Vc1 at either end of the power source electricity storage element C1 is applied to the load 3 through the switch circuit 4E. Load current IL flows as shown in FIG. 6 (C). In the illustrated example, during opening of the electromagnetic valve of the electronic carburetor, both the MOSFET 41 and 42 are held in the ON state for the duration of the valve opening time necessary for the operation to open the valve to be completed, causing the load current to rise sharply to the maximum current IL1 at the time of startup; thereafter, the load current is maintained at the maximum value through ON/OFF [control] of the upper stage MOSFET. After the operation to open the valve has been completed, the baseline for ON/OFF [control] of the upper stage MOSFET 41 is reduced, reducing the load current IL to a hold current value IL2, and the load current is maintained at the constant hold current value IL2, for the duration of the hold interval, with the valve maintained in the open state. In the illustrated example, driving of the load 3 terminates during the initial stage of the compression stroke.

If the microprocessor 4A loses its power source during driving of the load 3, operation of the microprocessor will halt and control will be lost. For this reason, in the case of driving a large load 3 such as solenoid, a timing is set for halting driving of the load 3, to limit the period for which the load 3 is driven, in such a way that the voltage Vc1 at either end of the power source electricity storage element C1 does not fall below a lower limit value Vmin of voltage necessary to sustain the voltage Vc2 at either end of the capacitor C2 (which is the power source voltage of the microprocessor 4A) at a voltage (e.g., 5 V) suitable as the power source voltage of the microprocessor 4A.

In cases in which large current flow is necessary for driving the load 3, by limiting the period for driving the load 3 in the aforedescribed manner, situations in which the microprocessor 4A loses its power source voltage, halting operation of the microprocessor, can be prevented.

As long as the electromagnetic valve of the electronic carburetor to be controlled in the present embodiment is held in the open state for the duration of the intake stroke, limiting the period for driving the solenoid (load 3) that drives the valve in the aforedescribed manner does not cause any trouble.

In order to limit the period for driving the load 3 as shown in FIG. 6, the microprocessor 4A may be configured to constitute a switch circuit control unit that, from a state in which the stroke determination unit A3 determines that the internal combustion engine stroke is in the exhaust stroke, once the first half wave voltage V11 is detected to have been generated, enables the supply of drive current to the load, while controlling the load-driving switch circuit 4E in such a way as to disable the supply of drive current to the load 3 when the voltage Vc1 at either end of the power source electricity storage element C1 has dropped to a set value set at or above the lower limit value Vmin of voltage necessary to sustain the microprocessor A4 in an operational state. This switch circuit control unit may be accomplished, for example, through microprocessor execution, at constant time intervals, of a process including a step of determining whether the internal combustion engine stroke is in the exhaust stroke; a step of determining whether the voltage at either end of the power source electricity storage element C1 is at or above a set value; a step of generating a load drive command when the first crank angle signal Scr1 has been input in a state in which the internal combustion engine stroke has been determined to be in the exhaust stroke; and a step of extinguishing the load drive command when determined that the voltage at either end of the power source electricity storage element C1 is less than the set value.

Figure 7:
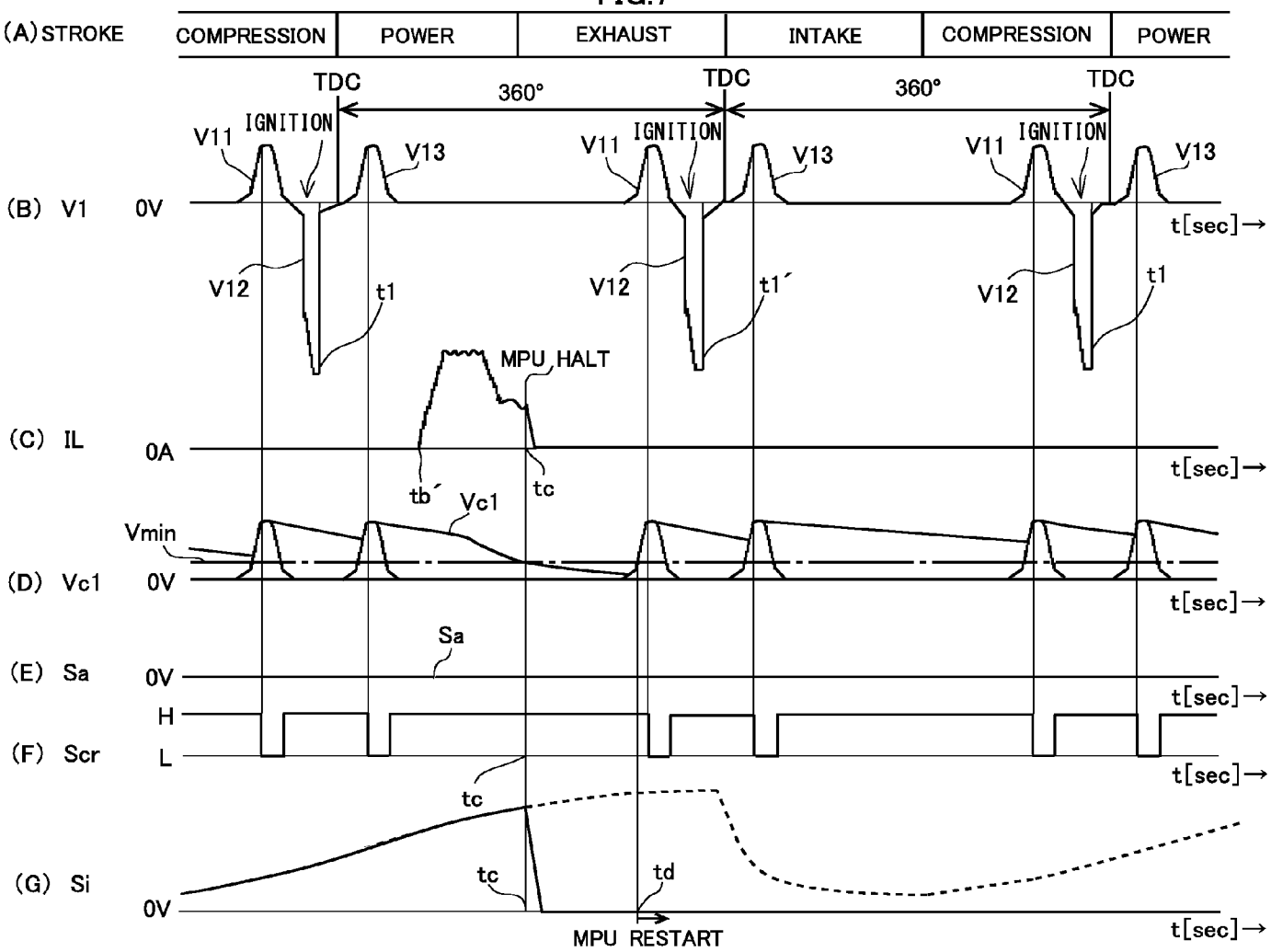
FIG. 7 is a timing chart showing possible states of units of the control device in the embodiment of FIG. 2, in a case in which a load is driven at inappropriate timing, wherein (A) is a timing chart showing change of the stroke of the internal combustion engine, (B) is a timing chart showing the timing of generation of half wave waveforms by the generator, (C) is a timing chart showing change of negative current, (D) is a timing chart showing change of voltage at either end of the electricity storage element, (E) is a timing chart showing the timing of generation and extinction of a charge-enable signal input to the microprocessor, (F) is a timing chart showing the timing of change of a crank angle detection signal output by the microprocessor, and (G) is a timing chart showing change of an output signal of the pressure sensor.

FIG. 7 (A) to (G) show a load current waveform and voltage waveforms of the various units, which may be observed in a case in which the load 3 (in this example, a solenoid), which requires considerable power for driving, is driven at inappropriate timing.

In the example shown in FIG. 7, driving of the load 3 is initiated, selecting a time tb' that follows charging of the power source electricity storage element C1 by the third half wave voltage V13 generated in the power stroke as the timing for initiating driving of the load 3. In this case, at time tc, which precedes the time at which the second wave voltage V12 is generated in the exhaust stroke, the voltage Vc1 at either end of the power source electricity storage element C1 falls below the minimum voltage value Vmin necessary to maintain the voltage Vc2 at either end of the capacitor C2 at a constant voltage (e.g., 5 V) suitable as the power source voltage of the microprocessor 4A, and therefore the microprocessor 4A loses its power source, microprocessor operation is halted, and driving of the load 3 is halted. In this example, because microprocessor operation remains halted from time tc onward, during the subsequent exhaust stroke, the thyristor Th1 is not presented with the charge-enable signal Sa and charging of the electricity storage element C1 does not take place, even when the second wave voltage V12 is generated in the magneto coil 10*a*. For this reason, the ignition operation does not take place at the ignition point t1 of the exhaust stroke. Moreover, at time tc, because power source voltage is not supplied to the pressure sensor 20 due to microprocessor operation having halted, the output signal Si of the pressure sensor 20 is extinguished. When the first half wave voltage V11 reaches the minimum voltage value Vmin or above at time td, the voltage at either end of the electricity storage element C1 reaches the voltage necessary to operate the microprocessor (MPU) 4A, and the microprocessor 4A restarts; however, detection of revolution speed does not take place at this time, and because the switch circuit constituting the sensor power source supply circuit 4G is in the OFF state, power source voltage is not presented to the pressure sensor 20. For this reason, output of the output signal Si by the pressure sensor 20 remains halted. As mentioned above, in the embodiment shown in FIG. 2, as long as the period for driving the load 3 is limited in such a way that the voltage Vc1 at either end of the power source electricity storage element C1 does not fall below the minimum value Vmin of voltage necessary to sustain the voltage Vc2 at either end of the capacitor C2 at a voltage suitable as the power source voltage of the microprocessor 4A, the occurrence of problems such as the aforedescribed can be avoided.

In cases in which a large drive current is not necessary for driving the load 3, there is no particular need to limit the period for driving the load 3; however, even in cases in which it is not necessary to limit the period for driving the load 3, in order to prevent the occurrence of situations in which control is lost due to halting of microprocessor operation, it is preferable to furnish the switch circuit control unit A6 for controlling the load-driving switch circuit 4E in such a way as to disable supply of drive current to the load 3 when the voltage Vc1 at either end of the power source electricity storage element C1 has fallen to a set value set at or above the minimum value Vmin of voltage necessary to sustain microprocessor operation.

While the aforedescribed embodiment takes the example of a case of controlling an electromagnetic valve of an electronic carburetor, the load 3 controlled by the control device 4 according to the present invention is not limited to a solenoid provided to an electronic carburetor, and the present invention can be applied also in cases of controlling other loads, such as a solenoid for driving an ISC valve provided for the purpose of adjusting idling speed in an internal combustion engine. Moreover, the present invention is not limited to cases in which the output of the power source circuit 4B is used to drive the load 3 to be controlled by the control device 4, and the present invention can be applied also in cases in which the output of the power source circuit 4B is supplied to a load other than a load to be controlled. For example, the voltage at either end of the power source electricity storage element C1 could be used to charge another electricity storage element, such as a small battery.

In the aforedescribed embodiment, the stroke of the internal combustion engine is determined from the output of a pressure sensor which detects internal pressure of the intake pipe of the internal combustion engine; however, the method for determining the stroke of the internal combustion engine is not limited to one that relies on internal pressure of the intake pipe. For example, it would be acceptable to instead furnish a cam angle sensor for detecting the revolution angle (cam angle) of the camshaft of the internal combustion engine, and to determine the stroke of the internal combustion engine from the cam angle detected from the output of the cam angle sensor. Moreover, the fact that the voltage waveforms at either end of the primary coil of the ignition coil 10 differ between the compression stroke and the exhaust stroke due to the difference between the pressure inside the cylinder when the internal combustion engine is in the compression stroke and the pressure inside the cylinder when the internal combustion engine is in the exhaust stroke (the fact that, during the compression stroke in which pressure inside the cylinder is higher, more time is needed to initiate discharge by the spark plug than during the exhaust stroke in which pressure inside the cylinder is lower) could be utilized to determine the compression stroke versus the exhaust stroke.

While the aforedescribed embodiment takes the example of a case of employing as the ignition device one provided with an ignition circuit of current cutoff type, the present invention can also be applied in cases in which an ignition circuit of capacitor discharge type is employed.

While the aforedescribed embodiment takes the example of a case in which the ignition coil is wound onto the stator of a magnet generator, and the primary coil of the ignition coil constitutes the magneto coil, the present invention can also be applied in cases in which the stator of a magnet generator is provided with a magneto coil only, while the ignition coil and the section that, together with the ignition coil, constitutes the ignition circuit are provided outside the magnet generator.

In the aforedescribed embodiment, the ignition circuit and the ignition control unit that controls the ignition circuit are provided to the stator of a magnet generator attached to an internal combustion engine. However, the components that, together with the ignition coil, constitute the ignition circuit, as well as the ignition control unit that controls the ignition point, may instead be provided within the control device 4 of the present invention. Regardless of whether the ignition control unit is provided within the control device of the present invention, or the ignition control unit is provided outside the control device, in cases in which control of the ignition control unit from the outside is possible, it is preferable to furnish means for inhibiting the flow of current from the magneto coil to the ignition circuit (in the aforedescribed embodiments, means for inhibiting the transistor TR1 from entering the ON state), in order to prevent a portion of the output of the generator from being lost to the ignition circuit when the second half wave voltage V12 is generated in the exhaust stroke. By adopting such a constitution, it is possible for all of the energy obtained from the magneto coil during the exhaust stroke to be stored in the power source electricity storage element of the power source circuit 4B within the control device, so the capacity of the power source circuit 4B can be increased.

In the aforedescribed embodiment, the first half wave voltage V11 and the third half wave voltage V13 induced in the magneto coil 10*a* have positive polarity, while the second half wave voltage V12 has negative polarity; however, it would be acceptable for the first half wave voltage V11 and the third half wave voltage V13 to have negative polarity, and the second half wave voltage V12 to have positive polarity.

The aforedescribed embodiment takes the example of a case in which a magnet generator of external magnet type is employed as the generator installed in the internal combustion engine; however, even in cases in which a magneto coil of internal magnet type is employed, the present invention can be applied in instances in which it is necessary for the power source circuit to be constituted in such a way that excess power from the magneto coil for driving the ignition device can be drawn, to supply power to a load other than the ignition device.

EXPLANATION OF NUMERALS AND CHARACTERS

1 External magnet type magnet generator
2 Spark plug
3 Load
4 Control device for internal combustion engine
4A Microprocessor
4B Power source circuit
4C Electricity storage element charging unit
4D Waveform processing circuit
4E Load-driving switch circuit
4F Switch driving circuit
5 Stop switch
6 Crankshaft
A1 Voltage monitoring unit
A2 Crank angle/revolution speed detection unit
A3 Stroke determination unit
A4 Charge-enable signal generation unit
A5 Power source supply command generation unit
A6 Switch circuit control unit

What is claimed is:

1. A control device for an internal combustion engine, employing a microprocessor to control a particular object to be controlled, the control device being provided to the internal combustion engine in which is installed a magnet generator having an ignition device-driving magneto coil for induction of alternating current voltage in association with revolution of the internal combustion engine, the half wave voltage induced in the magneto coil being employed for presenting ignition energy to an ignition device for ignition of the internal combustion engine; wherein the control device for the internal combustion engine comprises: a power source circuit having a power source electricity storage element, the power source circuit generating a power source voltage for presentation to the microprocessor and a power source voltage for presentation to a load other than the ignition device, from energy stored in the power source electricity storage element; an electricity storage element charging unit for charging the power source electricity storage element by the half wave induction voltage of the magneto coil employed for presenting ignition energy to the ignition device when a charge-enable signal is presented from the microprocessor; and a stroke determination unit for determining the stroke of the internal combustion engine; and the microprocessor is programmed to generate the charge-enable signal when the stroke determination unit has determined that the stroke of the internal combustion engine is the exhaust stroke.

2. A control device for an internal combustion engine, employing a microprocessor to control a particular object to be controlled, and provided to the internal combustion engine in which is installed a magnet generator that has a magneto coil for inducing, in association with revolution of the crankshaft, alternating current voltage of a waveform having a first half wave voltage of one polarity, a second half wave voltage of another polarity, generated following the first half wave voltage, and a third half wave voltage of the one polarity, generated following the second half wave voltage; the magnet generator used in order for the second half wave voltage induced by the magneto coil to present ignition energy to the ignition device for ignition of the internal combustion engine; wherein the control device for the internal combustion engine comprises: a power source circuit having a power source electricity storage element, the power source circuit generating a power source voltage for presentation to the microprocessor and a power source voltage for presentation to a load other than the ignition device, from energy stored in the power source electricity storage element; an electricity storage element charging unit having a first charging circuit for charging the power source electricity storage element by the first half wave voltage and the third half wave voltage induced in the magneto coil of the magnet generator, and a second charging circuit for charging the power source electricity storage element by the second half wave voltage induced in the magneto coil, when a charge-enable signal is presented from the microprocessor; and a stroke determination unit for determining the stroke of the internal combustion engine; and the microprocessor is programmed to generate the charge-enable signal when the stroke determination unit has determined that the stroke of the internal combustion engine is the exhaust stroke.

3. The control device for an internal combustion engine according to claim 2, further comprising: a load-driving switch circuit for controlling supply of drive current to the load; and a switch circuit control unit for controlling the load-driving switch circuit in such a way as to disable supply of drive current to the load when the voltage at both ends of the power source electricity storage element has dropped to a set value set at or above the lower limit value of voltage necessary to sustain the microprocessor in an operational state.

4. The control device for an internal combustion engine according to claim 2, further comprising: a load-driving switch circuit for controlling supply of drive current to the load; and a switch circuit control unit for controlling the load-driving switch circuit in such a way as to enable supply of drive current to the load, after generation of the first half wave voltage has been detected under a state in which the stroke of the internal combustion engine has been determined by the stroke determination unit to be in the exhaust stroke, and to disable supply of drive current to the load when the voltage at both ends of the power source electricity storage element has dropped to a set value which has been set at or above the lower limit value of voltage necessary to sustain the microprocessor in an operational state.

5. The control device for an internal combustion engine according to claim 2, provided with a pressure sensor for detecting the inlet pipe internal pressure of the internal combustion engine, the stroke determination unit being constituted so as to determine, from an signal outputted by the pressure sensor, that the stroke of the internal combustion engine is in the exhaust stroke.

6. The control device for an internal combustion engine according to claim 3, provided with a pressure sensor for detecting the inlet pipe internal pressure of the internal combustion engine, the stroke determination unit being constituted so as to determine, from a signal outputted by the pressure sensor, that the stroke of the internal combustion engine is in the exhaust stroke.

7. The control device for an internal combustion engine according to claim 4, provided with a pressure sensor for detecting inlet pipe internal pressure of the internal combustion engine, the stroke determination unit being constituted so as to determine, from a signal outputted by the pressure sensor, that the stroke of the internal combustion engine is in the exhaust stroke.

8. The control device for an internal combustion engine according to claim 5, provided with: a sensor power source supply circuit for presenting to the pressure sensor from the power source circuit a power supply voltage necessary for operation of the pressure sensor, doing so when a power supply command is presented from the microprocessor; and a waveform processing circuit for converting the first half wave voltage and the third half wave voltage into a signal of a waveform recognizable by the microprocessor, and presenting the signal to the microprocessor;

the microprocessor being programmed to monitor the voltage at either end of the power source electricity storage element, to detect the revolution speed of the internal combustion engine from the signal inputted from the waveform processing circuit, and to generate the power supply command when the voltage at either end of the power source electricity storage element exceeds a set value, and when the revolution speed exceeds a set value.

9. The control device for an internal combustion engine according to claim 6, provided with: a sensor power source supply circuit for presenting to the pressure sensor from the power source circuit a power supply voltage necessary for operation of the pressure sensor, doing so when a power supply command is presented from the microprocessor; and a waveform processing circuit for converting the first half wave voltage and the third half wave voltage into a signal of a waveform recognizable by the microprocessor, and presenting the signal to the microprocessor;

the microprocessor being programmed to monitor the voltage at either end of the power source electricity storage element, to detect the revolution speed of the internal combustion engine from the signal inputted from the waveform processing circuit, and to generate the power supply command when the voltage at either end of the power source electricity storage element exceeds a set value, and when the revolution speed exceeds a set value.

10. The control device for an internal combustion engine according to claim 7, provided with: a sensor power source supply circuit for presenting to the pressure sensor from the power source circuit a power supply voltage necessary for operation of the pressure sensor, doing so when a power supply command is presented from the microprocessor; and a waveform processing circuit for converting the first half wave voltage and the third half wave voltage into a signal of a waveform recognizable by the microprocessor, and presenting the signal to the microprocessor;

the microprocessor being programmed to monitor the voltage at either end of the power source electricity storage element, to detect the revolution speed of the internal combustion engine from the signal inputted from the waveform processing circuit, and to generate the power supply command when the voltage at either end of the power source electricity storage element exceeds a set value, and when the revolution speed exceeds a set value.

* * * * *